US007997677B2

(12) United States Patent
Navazo et al.

(10) Patent No.: US 7,997,677 B2
(45) Date of Patent: Aug. 16, 2011

(54) CONVERTIBLE PRINTER

(75) Inventors: Juan Manuel Valero Navazo, Sant Cugat del Valles (ES); David Claramunt Morena, Sant Esteve Sesrovires (ES); Jesus Garcia Maza, Terrassa (ES); Antonio Monclus Velasco, Castelledefels (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 503 days.

(21) Appl. No.: 12/212,087

(22) Filed: Sep. 17, 2008

(65) Prior Publication Data

US 2010/0066783 A1 Mar. 18, 2010

(51) Int. Cl.
*B41J 29/38* (2006.01)

(52) U.S. Cl. ..... 347/17; 347/1; 347/4; 347/104; 347/101; 347/102

(58) Field of Classification Search ..... 347/1, 4, 347/17, 101, 102, 104, 105
See application file for complete search history.

(56) References Cited

U.S. PATENT DOCUMENTS

| | | | | |
|---|---|---|---|---|
| 4,774,523 | A | 9/1988 | Beaufort et al. | |
| 4,982,207 | A | 1/1991 | Tunmore et al. | |
| 5,337,132 | A | 8/1994 | Cherian | |
| 5,467,119 | A | 11/1995 | Richtsmeier et al. | |
| 5,668,584 | A | 9/1997 | Broder et al. | |
| 5,784,679 | A | 7/1998 | Schlueter, Jr. et al. | |
| 5,872,579 | A * | 2/1999 | Handa et al. | 347/8 |
| 6,168,269 | B1 | 1/2001 | Rasmussen et al. | |
| 6,342,689 | B1 | 1/2002 | Ishigaki et al. | |
| 6,406,118 | B1 | 6/2002 | Aoki et al. | |
| 6,516,164 | B1 | 2/2003 | Kawazu | |
| 6,554,514 | B2 | 4/2003 | Wotton et al. | |
| 6,934,484 | B2 | 8/2005 | Suzuki et al. | |
| 7,002,105 | B2 | 2/2006 | Suzumi | |
| 7,139,500 | B2 | 11/2006 | Kawazu et al. | |
| 7,199,335 | B2 | 4/2007 | Takami et al. | |
| 7,203,439 | B2 | 4/2007 | Sone et al. | |
| 7,216,968 | B2 | 5/2007 | Smith et al. | |
| 7,241,003 | B2 | 7/2007 | Fellingham et al. | |
| 7,295,789 | B2 | 11/2007 | Inukai | |
| 2004/0037597 | A1 | 2/2004 | Haseba et al. | |
| 2006/0045589 | A1 | 3/2006 | Iwasaki et al. | |
| 2006/0062609 | A1 | 3/2006 | Kinouchi et al. | |
| 2006/0157464 | A1 | 7/2006 | Omata et al. | |

FOREIGN PATENT DOCUMENTS

| | | | |
|---|---|---|---|
| EP | 0568174 | A1 | 11/1993 |
| EP | 1101621 | A1 | 5/2001 |

OTHER PUBLICATIONS

"Zund UVjet 250-Combi," ZUND swiss printing and cutting, Sep. 2006 (4 pages).

* cited by examiner

*Primary Examiner* — Laura E Martin

(57) ABSTRACT

A convertible printer usable with either a flexible media or rigid media is disclosed.

15 Claims, 5 Drawing Sheets

CONVERTIBLE PRINTER

BACKGROUND

In this information age, printers have become a nearly indispensable part of life. With these developments, printing has moved well beyond the traditional use of paper as a print media, as printing now extends to many other types of media, such as wood, metal, foam, and many other types of rigid materials. Moreover, numerous types of inks and/or toner are used to achieve different effects on a particular type of media.

Some inks, such as solvent inks, work best upon application of some form of heat while some other inks, such as ultraviolet-curable inks, typically do not require heating. In addition, a preferred heating or drying mechanism suitable for use with solvent inks and/or flexible media may not be helpful when printing on a rigid media and/or when using other inks, such as the ultraviolet-curable inks. In fact, because high quality printing is very dependent upon the type of media, the type of ink, and how the ink is dried or cured, a quite diverse range of printers exists. Accordingly, a conventional printer typically uses just one type of ink, such as a solvent ink. Likewise, in this environment, a conventional printer also would typically use just one type of media, such as a rigid media, while a different conventional printer would employ a different type of media, such as a flexible media arranged in a roll-to-roll configuration.

The significant differences between the many different types of inks and the many different types of media, as well as the different sizes and shapes of media, can result in a business owning many different types of printers—with each different printer dedicated for a different purpose. This seeming duplicity frequently raises maintenance costs, increases training time, increases ink costs, and occupies a lot of space, among other challenges. Accordingly, most businesses and consumers face a daunting task of choosing the right combination of printers and associated equipment to meet their goals.

DETAILED DESCRIPTION

In the following Detailed Description, reference is made to the accompanying drawings, which form a part hereof, and in which is shown by way of illustration specific embodiments which may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following Detailed Description, therefore, is not to be taken in a limiting sense, and the scope of the present disclosure defined by the appended claims.

Embodiments of the present disclosure provide a convertible, hybrid printer that allows printing with either a flexible media or rigid media. The convertible, hybrid printer includes one or more selectively activatable heating mechanism on opposite sides of a print-heat zone so that the appropriate type of heating is always available, regardless of whether the flexible media or the printed media is being printed upon. Moreover, the convertible, hybrid printer allows repositioning of a vertical spacing between the print-heat assembly and a media assembly to accommodate the different thicknesses of the respective flexible and rigid types of media.

These embodiments, and additional embodiments, are described in association with FIGS. 1-6.

Figure 1:
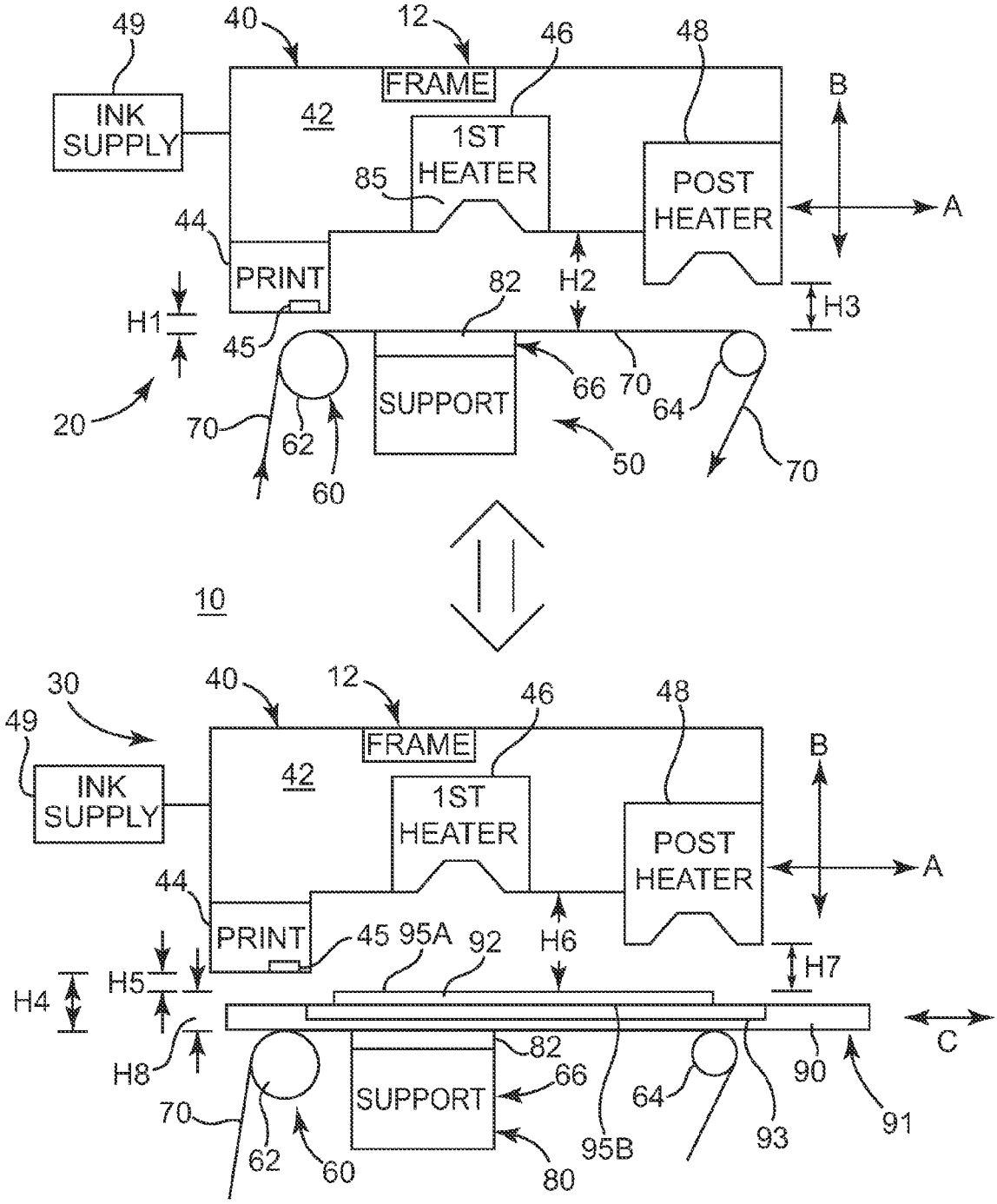
FIG. 1 is a diagram schematically illustrating a convertible printing system, according to one embodiment of the present disclosure.

As illustrated in FIG. 1, in accordance with one embodiment of the present disclosure, a printing system 10 includes a printer 12, which is convertible between a first configuration 20 and a second configuration 30. As shown in FIG. 1, printer 12 includes a print-heat assembly 40 and a media assembly 50. The print-heat assembly 40 includes a frame 42 which supports a print station 44, a first heater 46, and a post heater 48. In one aspect, the print station 44 includes a printhead array 45 configured to eject ink onto a media such as media web 70. The print-heat assembly 40 also includes, or is in communication with, an ink supply 49 to supply ink to printhead array 45 of the print station 44. In one embodiment, the first heater 46 and/or the post heater 48 comprise a radiant heater, convective heater, combinations thereof, or another non-contact heating mechanism, as known in the art. In one aspect, a post heater 48 generates and directs a substantially higher temperature heat than the first heater 46. In another aspect, first heater 46 and post heater 48 are positioned to face a printing side of media web 70 and hence, are sometimes herein referred to as print-side heaters.

In one aspect, frame 42 is configured to maintain the print station 44, the first heater 46, and the post heater 48 in a fixed relationship to one another in both the vertical orientation (as represented by directional arrow B) and the horizontal orientation (as represented by directional arrow A). In one aspect, because printing station 44, first heater 46, and post heater 48 extend along the same general horizontal orientation, each of these respective components are all aligned to act on a portion of media web 70 that extends in a single generally horizontal plane (i.e. a plane that is generally parallel to the generally horizontal orientation through which printing station 44, first heater 46, and post heater 48 extend) within the print-heat zone.

The media assembly 50 comprises a roller system 60 that includes at least rollers 62 and 64 and which is configured to provide rolling support for the media web 70. As shown in FIG. 1, media web 70 includes directional arrows for illustrative purposes to indicate the direction of travel of media web 70. In one aspect, the media assembly 50 also includes an intermediate support 66 configured to further support media web 70 between rollers 62 and 64. In one aspect, intermediate support 66 is positioned on a non-printing side of media web 70, i.e. on a side of media web 70 that is opposite the printing side of media web 70 where first heater 46 and post heater 48 are located.

As further illustrated in FIG. 1, in the first configuration 20, printhead array 45 of station 44 is vertically spaced above media web 70 by a distance of H1 while first heater 46 is vertically spaced above media web 70 by a distance of H2 (with the position of media web 70 being measured at a top portion of roller 62 or at a top portion 82 of intermediate support 66). The post heater 48 is vertically spaced above media web 70 by a distance of H3 (via measuring the position of media web 70 at a top portion of roller 64 or at the top portion 82 of intermediate support 66). As previously mentioned, frame 42 maintains the fixed relative vertical spacing between print station 44, first heater 46 and post heater 48.

In the first configuration 20, both first heater 46 and post heater 48 are activated. Accordingly, as the media web 70 travels through the print-heat zone (established by print-heat assembly 40), print station 44 ejects ink onto the media web 70 with the first heater 46 and post heater 48 subsequently heating the printed ink on media web 70.

Printhead array 45 comprises a plurality of drop-on-demand fluid ejection devices. In one embodiment, the fluid ejection devices comprise thermal inkjet print heads while in other embodiments, the fluid ejection devices comprise piezoelectric printheads or other printheads known in the art.

In some embodiments, ink supply 49 includes a low-solvent ink or an aqueous ink that includes at least a pigment and a latex component, as well as water and/or minimal solvents. Once ejected onto media web 70, the water and/or minimal solvents are effectively removed through evaporation while the latex and pigment remains on media web 70. As the printed ink on the web 70 passes by first heater 46 and post heater 48, the latex is heated to a temperature sufficient to form a film over the pigment, thereby securing the latex-pigment mix to the media web 70.

A second configuration 30 of printer 12 is provided to accommodate other types of media, such as rigid media 92 that is not provided in a roll-to roll configuration. In the second configuration 30, print-heat assembly 40 and media assembly 50 include at least substantially the same features and attributes as print-heat assembly 40 and media assembly 50 in the first configuration 20. However, in the second configuration 30, media assembly 50 also includes additional features and attributes as described herein. In particular, media assembly 50 additionally includes a rigid media support mechanism 91 including a media carrier 90 configured to releasably retain the rigid media 92 thereon. In one aspect, the rigid media 92 includes a print side 95A and a non-print side 95B.

Furthermore, to accommodate the introduction of the rigid media support mechanism 91, print-heat assembly 40 is raised to a more elevated position, as can be recognized by the increased vertical spacing between the print station 44 and media web 70 (as measured at roller 62 or at top portion 82 of support 66, as previously described). This increased vertical spacing is generally represented by the difference between the vertical spacing between printhead array 45 and a top portion of roller 62 in the first configuration 20 (as represented by H1) and the greater vertical spacing between printhead 45 and a top portion of roller 62 in a second configuration 30 (as represented by H4). This increased vertical spacing is primarily used to accommodate a combined thickness of the media carrier 90 and rigid media 92 (as represented by indicator H8), which is substantially greater than the relatively negligible thickness of media web 70.

It is also understood that the print-heat assembly 40 is movable along a generally continuous range of vertical positions above the media assembly 50. Accordingly, when system 10 is deployed in the second configuration 30, the print-heat assembly 40 is not limited to a single vertically spaced position, but rather the print-heat assembly 40 is configured for variable vertical positioning above the rigid media 92 and media carrier 90. Moreover, when system 10 is deployed in the first configuration 20, the print-heat assembly 40 is also configured for variable vertical positioning above the flexible media web 70. Accordingly, the print-heat assembly 40 is configured to be moved into a first range of vertically spaced positions to accommodate different thicknesses of a flexible media and a second range of positions to accommodate different thicknesses of a rigid media. In one non-limiting example, in addition to accommodating the thickness of media carrier 90, the variable vertical position of the print-heat assembly 40 can accommodate a relatively thick rigid media 92 (e.g., 50 to 100 mm) or a relatively thin rigid media 92 (e.g., 1 to 2 mm).

In another aspect, as illustrated by FIG. 1, printhead array 45 is separated from media 92 by a vertical spacing, represented by H5, while first heater 46 is separated from media 92 by a vertical spacing, represented by H6. Post heater 48 is separated from media 92 by a vertical spacing, as represented by H7. In one embodiment, the distance H1 is substantially equal to the distance H5, while the distance H2 is substantially equal to the distance H6, and the distance H3 is substantially equal to the distance H7. However, in other embodiments of the distances H1, H3, H3 are not substantially equal to the distances H5, H6, H7, respectively, as an operator may choose to have a different print-to-media spacing for each of the different types of media.

In one embodiment, in the second configuration 30, because of the relatively large thickness of rigid media 92 (as compared to the negligible thickness of the flexible media web 70) heat is applied to both the print-side 95A and the non-print side 95B of rigid media 92. Accordingly, in this arrangement, the first heater 46 heats the ink that has been printed onto rigid media 92, causing the ink to bond onto the rigid media 92. When the ink is a low-solvent ink, such as the earlier described latex-pigment type ink, the first heater 46 causes melting of the latex component of the latex-pigment ink to bond the both the pigment and the latex to the rigid media 92. In addition, post heater 48 is available to provide additional heating or drying of the printed ink on the rigid media 92.

In some embodiments, media carrier 90 comprises additional features for ensuring high-quality printing of ink on the media web 70. For example, in one embodiment, as illustrated in FIG. 1, media carrier 90 comprises a heating mechanism 93. In one aspect, as the contact member 190 is heated (via an electrical source or a heat source that is not shown), the contact member 190 conductively heats the non-print side 95B of rigid media 92. Because first heater 46 is heating print-side 95A of rigid media 92, this heating action applied via heating mechanism 93 minimizes the temperature differential that would otherwise occur between the print-side 95A and the non-print side 95 of rigid media 92 (due to the relatively large thickness of rigid media 92). Accordingly, first heater 46 causes bonding of the latex-pigment ink on the print-side 95A of rigid media 92 while the heating mechanism 93 of media carrier 90 prevents bending of the rigid media 92 that would otherwise occur due to a different thermal expansion on the print-side 95A and non-print side 95B of rigid media 92 (in the absence of the heating mechanism 93).

In another aspect, in the second configuration 30, rigid media support mechanism 91 is configured to move media carrier 90 in a back-and-forth path (as represented by directional arrow C) under the print-heat assembly 40 so that different patterns of ink are printed onto the rigid media 92 in successive passes of the media carrier 90 underneath the print-heat assembly 40. Accordingly, in some embodiments, the heating mechanism 93 further includes a retaining mechanism to ensure stable positioning of rigid media 92 during movement of media carrier 90. In some embodiments, this retaining mechanism is incorporated within a top portion of media carrier 90 as an array of vacuum ports 194 that are in fluid communication with a negative pressure source 196, as illustrated in the partial, sectional view of FIG. 2. With this in mind, by the application of a vacuum force through ports 194, this retaining mechanism releasably, securely retains rigid media 92 on media carrier 90. However, it is understood that in other embodiments, instead of a vacuum-based retaining mechanism. Rigid media support mechanism 91 and media carrier 90 comprise other types of retaining mechanisms, such as mechanical clasps, friction-based holders, pressure sensitive adhesives and the like.

Additional features and attributes of the second configuration 30, including the rigid media support mechanism 91, will be later described in more detail in association with FIG. 5-6.

Accordingly, as illustrated in FIG. 1, printer 12 is convertible between use with a flexible media in the first configuration 20 and use with a rigid media in the second configuration 30. Because frame 42 of the print-heat assembly 40 maintains first heater 46 and post heater 48 in a fixed vertical relationship relative to print station 44, a vertical adjustment of the print station 44 to accommodate a different thickness media (whether a flexible media or a rigid media on a media carrier) will automatically reposition the respective first heater 46 and the post heater 48 by a corresponding vertical adjustment. Moreover, because printer 12 includes both the first heater 46 (which is a print-side heater) and heatable media carrier 90 (which is a non-print side heater), printer 12 acts as a hybrid printer that can be used to print both a flexible media 70 or a rigid media 92. These different types of media can be readily accommodated by printer 12 via adjusting the vertical spacing of the print-heat assembly 40 to accommodate the generally thicker rigid media 92 (and its rigid support mechanism 91) or to accommodate the generally thinner flexible media 70. It is also understood that this vertical spacing (i.e., a pen-to-paper spacing) is continuously adjustable within a range such that the print-heat assembly 40 is not strictly limited to a single rigid media position or a single flexible media position. Moreover, because the first heater 46 and the heatable media carrier are positioned on opposite sides of media web 70, the appropriate combination of heating mechanisms are available, regardless of whether printing occurs on a flexible media or on a rigid media.

In another embodiment, printer 12 can be used in the second configuration 30 to print on a non-rigid media or flexible media that has a thickness comparable to the rigid media 92.

Figure 3:
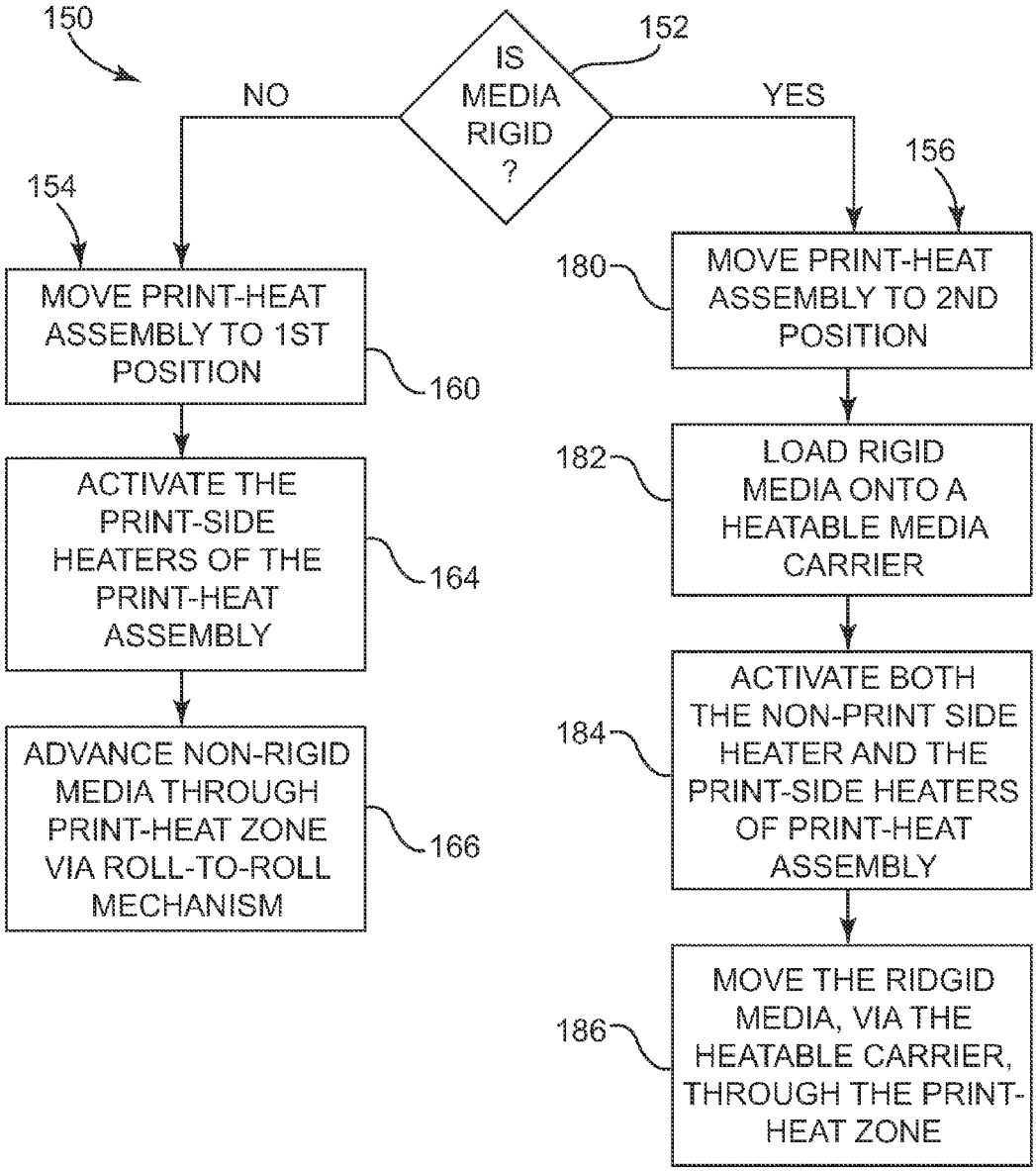
FIG. 3 is a flow diagram of a method of printing, according to one embodiment of the present disclosure.

FIG. 3 is a flow diagram of a method 150 of printing, according to an embodiment of the present disclosure. In one embodiment, method 150 employs a printer having substantially the same features and attributes as the convertible printer 12, previously described in association with FIGS. 1-2. As shown in FIG. 3, at decision box 152, method 150 queries whether the media (to be printed upon) is a rigid material. If the query is answered affirmatively (i.e. yes), then method 150 initiates protocol 156 at box 180 in which a print-heat assembly, such as print-heat assembly 40, is moved to a second range of positions that allowing greater vertical spacing below a print station to accommodate the thickness of the media carrier 90 and the generally thicker rigid media (as compared to a nominal thickness of a flexible media). In addition, as shown at box 182, rigid media 92 is loaded onto the media carrier 90 for introduction into the print-heat zone. In protocol 156, both a non-print side heater and the print-side heaters (such as first heater 46 and a post heater 48) are activated as indicated at box 184. In one aspect, the non-print side heater is provided via the heating mechanism 93 of media carrier 90. The protocol 156 also includes moving the rigid media, via the heatable media carrier 90, through the print-heat zone to print ink onto the rigid media, as shown at box 186.

However, if the query at decision box 152 is answered negatively (i.e. no, the material is not rigid but is a flexible or non-rigid material), then method 150 initiates protocol 154 at box 160 in which a print-heat assembly, such as print-heat assembly 40, is moved to a first range of positions to achieve less vertical spacing below a print station to accommodate an absence of media carrier 90 and a generally thinner flexible media (as compared to the generally greater, typical thickness of the rigid media 92). In addition, as shown at box 162, the print-side heaters (such as first heater 46 and post heater 48) are activated as indicated at box 164. The protocol 154 continues with loading of the flexible media onto a roll-to roll mechanism, whereby a non-rigid media or flexible media is advanced through the print-heat zone for printing of ink onto the flexible media. Because the media carrier 90 is not employed in protocol 154, the non-print side heater (such as heating mechanism 93 of media carrier 90) is not used to heat the flexible media in protocol 154.

In one embodiment, the protocol 154 of method 150 illustrated in FIG. 3 substantially corresponds to use of printer 12 in the first configuration 20, as illustrated in FIG. 1. In another embodiment, the protocol 156 of method 150 illustrated in FIG. 3 substantially corresponds to using printer 12 in its second configuration 30, as illustrated in FIG. 1.

It is also understood that the various functions within each protocol 154, 156 may be performed in a different order than that shown in FIG. 3 and that some functions illustrated and described in association with FIG. 3 can be performed simultaneously.

Figure 4:
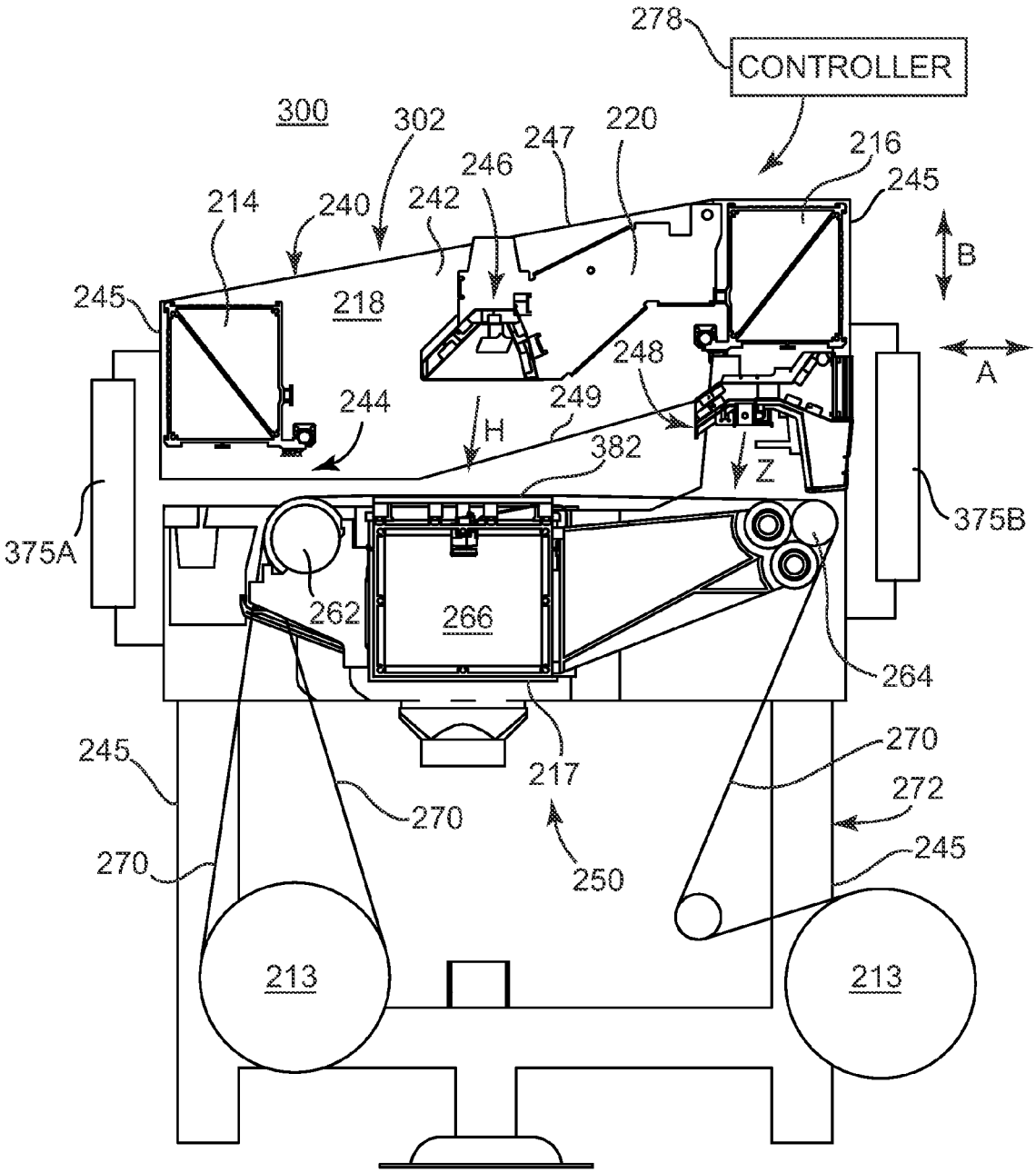
FIG. 4 is a side plan view a convertible printer in a flexible media configuration, according to one embodiment of the present disclosure.

FIG. 4 is a side plan view of a convertible, hybrid printing system 300, according to one embodiment of the present disclosure. In FIG. 4, printing system 300 is shown in a first configuration 302 while the same printing system 300 is shown in FIGS. 5-6 in its second configuration 350. As shown in FIG. 4, a print-heat assembly 240 and a media assembly 250 each include at least substantially the same features and attributes of print-heat assembly 40 and media assembly 50, respectively, as previously described in association with FIGS. 1-2. With this in mind, like reference numerals in FIG. 4 (e.g. print-heat assembly 240) describe like components in FIG. 1 (e.g. print-heat assembly 40). Accordingly, print-heat assembly 240 includes a movable frame 242 that supports a print station (indicated generally by 244), first heater 246, post heater 248, and other components.

As illustrated in FIG. 4, frame 242 includes beams 214 and 216 which are spaced apart from each other along a horizontal orientation (as represented by directional arrow A) and along a vertical orientation (as represented by directional arrow B). In general, beams 214, 216 are illustrated in an end view in FIG. 4, but can be best seen in a perspective view in FIG. 6. As shown in FIG. 6, beams 214, 216 have a length that extends generally transverse to the travel direction of media web 70. Accordingly, beams 214, 216 support frame 242 (including print station 244, first heater 246, and post heater 248) to extend across media web 70, generally transverse to the travel direction of media web 70. The beams 214, 216 are connected together by one or more cross-support members 218 which form end pieces of frame 242, as further illustrated in FIG. 6.

In one aspect, as further illustrated in FIG. 4, frame 242 further includes support member(s) 220 which extend generally inward and downward from beam 216 to thereby position first heater 246 over media assembly 250 in the print-heat zone. In this arrangement, first heater 246 is located along the path of the media web 270, being interposed between print station 244 and post heater 248. Moreover, while the print station 244 is positioned to be in close proximity to the media web 270 adjacent roller 262, first heater 246 is substantially spaced apart from media web 270 and positioned generally across from beam 217 of media assembly 250.

In one aspect, frame 242 also defines a top portion 247 and a bottom portion 249 with bottom portion 249 being vertically spaced above media web 270.

Media assembly 250 includes rollers 262, 264 which support media web 270 as media web 270 passes through a print-heat zone defined by the print station 244, first heater 246 and post heater 248. In one aspect, rollers 213 provide a media supply and a media rewind. Media assembly 250 also comprises a beam 217 that extends transversely to the direction of travel of media web 270. In one embodiment, beam 217 further defines an intermediate support 266, which includes a top portion 382 for further supporting media web 270 in the print-heat zone.

In one embodiment, media assembly 250 additionally comprises a frame 272 (e.g. a table) that generally supports media assembly 250 in a vertical orientation and which also supports print-heat assembly 240 vertically above media assembly 250 via a pair of actuator mechanisms 375A, 375B, which are schematically illustrated in FIG. 4. In one embodiment, actuator mechanism 375A, 375B is disposed at ends 243 of print-heat assembly 240 with ends 243 illustrated in FIG. 6. However, for illustrative purposes, actuator mechanism 375A, 375B is shown in FIG. 4 as being located on opposite sides 245 of frame 242. In either case, it is understood that the actuator mechanism 375A, 375B is positioned so as to not interfere with the advancement of media web 70 or other primary functioning of the print-heat assembly 40.

Regardless of whether it is positioned on the sides or the ends of print-heat assembly 40, the actuator mechanism 375A, 375B is positioned and configured to cause selective vertical positioning of the print-heat assembly 240 relative to media assembly 250. With this arrangement, the printing system 300 can be converted between the first configuration 302 (shown in FIG. 4) and the second configuration 350, shown in FIGS. 5-6. In one aspect, the actuator mechanism 375A, 375B comprises one or more hydraulic lift mechanisms or other mechanisms known in the art for providing selective vertical positioning.

Controller 278 comprises one or more processing units and associated memories configured to generate control signals directing the operation of printing system 300, including print-heat assembly 240 and media assembly 250. In addition, in response to or based upon commands received via a user input or instructions contained in the memory of controller 278, controller 278 also generates control signals directing operation of actuator mechanism 375A, 375B to selectively control the vertical position of print-heat assembly 240 relative to media assembly 250. In this way, printing system 300 is converted between use in the first configuration 302 (shown in FIG. 4) to accommodate a flexible media and the second configuration 350 (shown in FIGS. 5-6) to accommodate a rigid media.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 50 may be embodied as part of one or more application-specific integrated circuits (ASICs). Unless otherwise specifically noted, the controller is not limited to any specific combination of hardware circuitry and software, nor limited to any particular source for the instructions executed by the processing unit.

Accordingly, with this arrangement shown in FIG. 4, in its first configuration 302 printing system 300 operates in substantially the same manner as printer 12 when in its first configuration 20, as previously described in association with FIGS. 12.

Referring again to FIGS. 5-6, in one embodiment, printing system 300 is positionable into its second configuration 350 and in this second configuration 350, additionally comprises first lateral support mechanism 280 and second lateral support mechanism 310. In one embodiment, first lateral support mechanism 280 comprises a table 281 including legs 283, a tabletop 285, and an array 284 of rollers 287 extending across the table top 285. As illustrated in FIG. 5, the table 281 is arranged and positioned to be immediately adjacent a first side 320 of media assembly 250 to be located near roller 262 and print station 244 of print-heat assembly 240.

In one embodiment, second lateral support mechanism 310 includes a table 301 including legs 303, a tabletop 305, and the previously described, rigid media support mechanism 291. The rigid media support mechanism 291 includes a media carrier 290 that is slidably movable relative to tabletop 305 of the second lateral support mechanism 310 and which is configured to receive and releasably retain rigid media 292. In another aspect, media carrier 290 includes a heating mechanism 293 that is configured to provide contact heating of the non-print side 295B of rigid media 292 during heating from first heater 246 to thereby maintain a generally uniform temperature gradient between the print side 295A and the non-print side 295B of rigid media (which thereby prevents unwanted bending of media 292).

Figure 2:
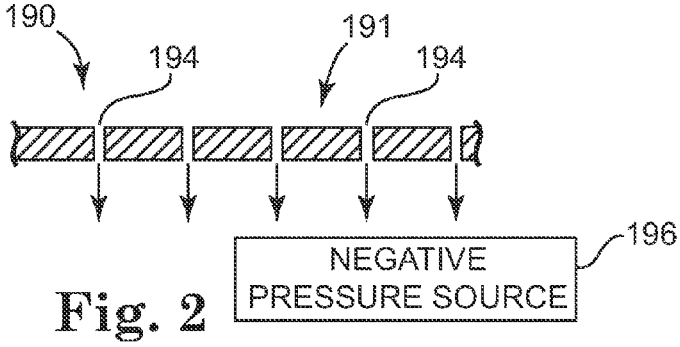
FIG. 2 is a partial, enlarged sectional view of a heating and retaining mechanism, according to one embodiment of the present disclosure.

In one embodiment, heating mechanism 293 of media carrier 290 comprises substantially the same features and attributes as heating mechanism 93 (as previously described in association with FIGS. 1-2). Accordingly, with this arrangement, media carrier 290 is configured to releasably retain and heat the non-print side 295B of rigid media 292 as media carrier 290 travels back-and-forth (as represented by directional arrow C) relative to media support assembly 250 and over tabletop 305 of the second lateral support mechanism 302.

In one embodiment, a control mechanism 306 extends from, and is in communication with, rigid media support mechanism 291 to control slidable movement of media carrier 290 and the vacuum applied to media carrier 290. In another aspect, control mechanism 306 provides control over, and electrical communication with, heating mechanism 293 of media carrier 290. In one aspect, control mechanism 306 is in communication with controller 278 to coordinate control of media carrier 290 with the other functions of print-heat assembly 240 and media assembly 250.

Figure 5:
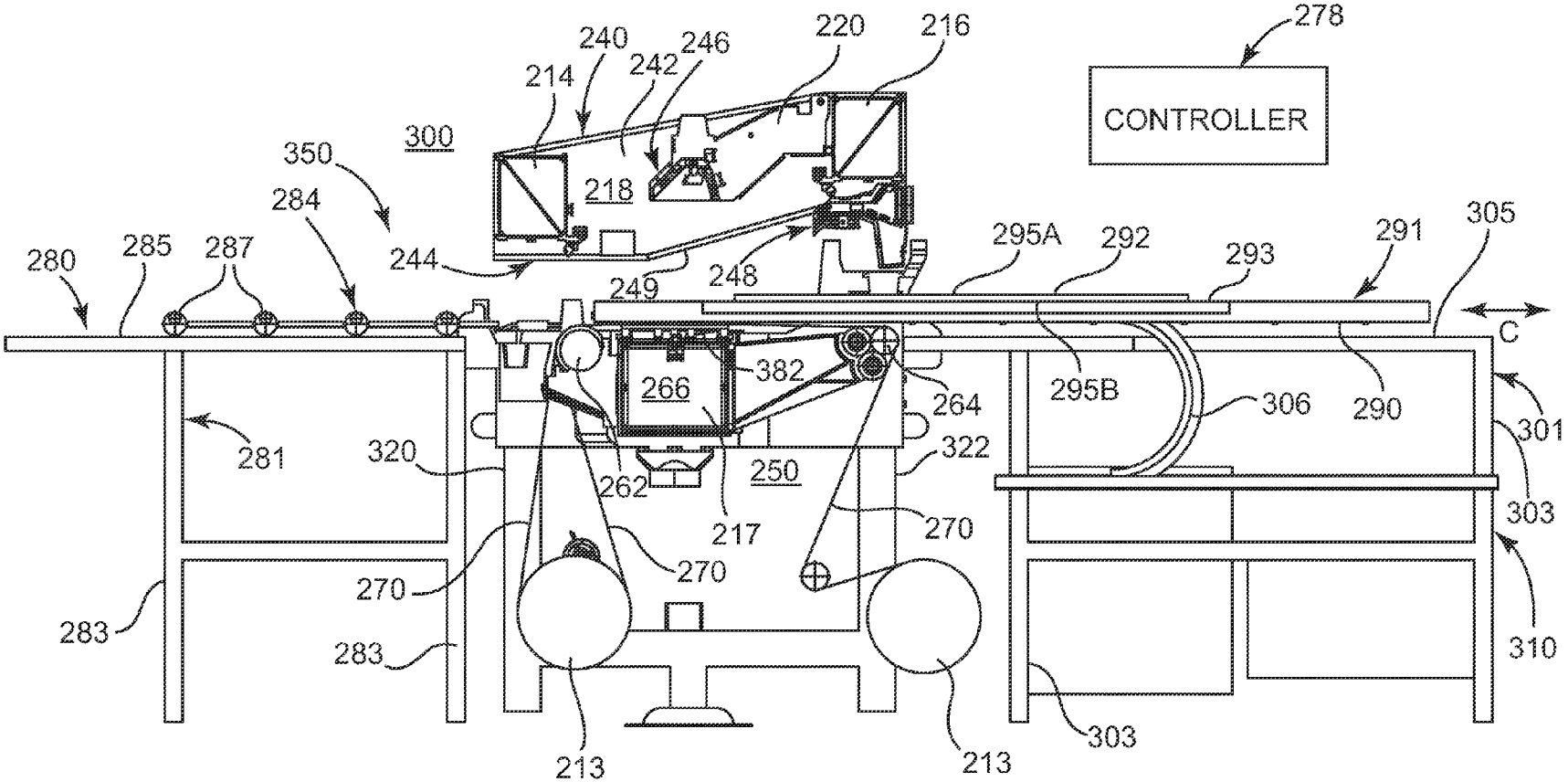
FIG. 5 is a side plan view a convertible printer in a rigid media configuration, according to one embodiment of the present disclosure.
Figure 6:
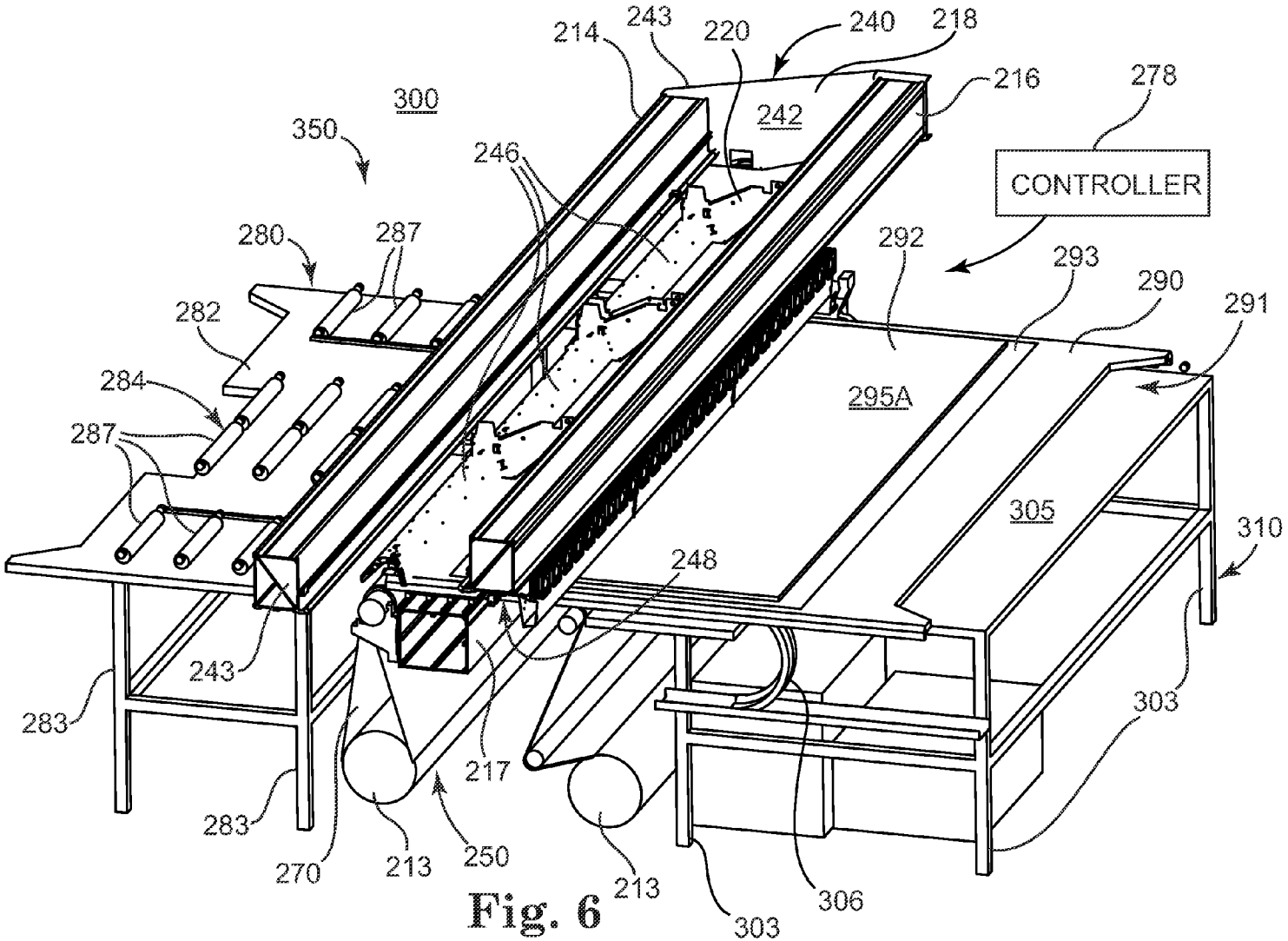
FIG. 6 is a perspective view of the convertible printer of FIG. 5, according to one embodiment of the present disclosure

As further illustrated by FIGS. 5-6, second lateral support mechanism 310 is positioned and arranged to be immediately adjacent second side 322 of media assembly 250 so that media carrier 290 of the rigid media support mechanism 291 is positioned for movement through the print-heat zone between print-heat assembly 240 and media assembly 250.

With the first lateral support mechanism 280 positioned on first side 320 of media assembly 250 and the second lateral support mechanism 310 positioned on the second side 322 of media assembly 250, movement of media carrier 290 of rigid media support mechanism 291 (as represented by directional arrow C) is fully supported on either side of media assembly 250. For example, when the rigid media support mechanism 291 advances media carrier 290 to extend outwardly beyond first side 320 of media assembly 250, rollers 287 of first lateral support mechanism 280 provide rolling support for media carrier 290 of rigid media support mechanism 291. With this arrangement, a smooth controlled motion of rigid media 292 is maintained during printing of ink from print-head array 245 of print station 244 onto rigid media 292.

In one aspect, in a manner substantially similar to that previously described for printer 12 in connection with FIG. 1, when the second configuration 350 of printer 300 is adapted to accommodate rigid media 292, heating mechanism 293 of media carrier 290 acts to heat a non-printing side of rigid media 292. As in the first configuration 302, both the first heater 246 and post heater 248 located on the printing side of media web 272 are activated to direct heat (as schematically indicated by directional arrow H in FIG. 4) onto the print-side of rigid media 292 (and the printed ink thereon).

It is also understood that in the second configuration 350 and with the introduction of media carrier 290 (and the rigid media 292 thereon) between print-heat assembly 240 and media assembly 250, printing system 300 provides a generally increased vertical spacing between printing station 244 and media web 270 (as compared to the nominal vertical spacing provided in the first configuration 302). In one aspect, the position of media web 270 is measured at a top portion of first roller 262 or at top portion 382 of intermediate support 266) to enable achieving proper print-to-media spacing (i.e., pen-to-paper spacing).

Embodiments of the present disclosure provide a convertible, hybrid printer that allows printing with either a flexible media or rigid media and which includes different types of heaters on opposite sides of a print-heat zone so that the appropriate type of heating is readily available, regardless of whether the flexible media or the printed media is being printed upon.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printer comprising:

a media assembly configured to rollingly support a media along a generally horizontal orientation, and including a contact heating mechanism configured to be selectively deployable on a non-printing side of the media;

a print-heat assembly including a printing mechanism and a non-contact heating mechanism disposed on a printing side of the media; and a controller causing selective operation of the printer in at least one of:

a first mode in which the print-heat assembly is at a first height above the media assembly, the media comprises a flexible media, and the contact heating mechanism is not deployed; and a second mode in which the print-heat assembly is at a second height above the media assembly, wherein the second height is substantially greater than the first height, the media comprises a rigid media, and the contact heating mechanism supports the rigid media.

2. The printer of claim 1 wherein in both the first mode and the second mode, the non-contact heating mechanism is activated, wherein the non-contact heating mechanism comprises a first heater and a post heater laterally spaced apart from the first heater along the generally horizontal orientation, and wherein the first heater is located closer to the printing mechanism than the post heater.

3. The printer of claim 2 wherein the printer includes a first frame configured to support both the printing mechanism and the non-contact heating mechanism and configured to maintain the non-contact heating mechanism and the printing mechanism in a fixed spaced relationship along the generally horizontal orientation and along a generally vertical orientation.

4. The printer of claim 3 wherein in the first mode the media assembly comprises a second frame supporting the flexible media via a roll-to-roll mechanism, wherein in the second mode, the media assembly additionally comprises a media carrier slidably movable relative to the second frame along the generally horizontal orientation, and wherein the media carrier is configured to releasably retain the rigid media thereon and configured to include the contact heating mechanism.

5. The printer of claim 4 wherein in the second mode, the media assembly comprises:

a first lateral support mechanism disposed on a first side of the second frame;

a second lateral support mechanism disposed on a second side of the second frame opposite the first side; and a control mechanism connected to the media carrier and configured to cause the slidable movement of the media carrier relative to the second frame, wherein at least one of the first lateral support mechanism and the second lateral support mechanism rollingly support the media carrier.

6. The printer of claim 4 wherein the media carrier comprises a retaining mechanism including an array of vacuum ports in fluid communication with a negative pressure source via the control mechanism.

7. The printer of claim 4 wherein the contact heating mechanism comprises a metallic platen heater.

8. The printer of claim 1 wherein the printer is an inkjet printer and wherein the inkjet printer prints an image on a media using an aqueous ink comprising at least a pigment and a latex component.

9. The printer of claim 1, comprising:

a vertical positioning mechanism configured to cause selective vertical positioning of the print-heat assembly relative to the media assembly.

10. A method of printing:

supporting a media, via a first frame, to travel along a generally horizontal orientation, including removably providing a contact heater on a non-printing side of the media;

supporting a print-heat assembly, via a second frame, on a printing side of the media and arranging the print-heat assembly to include a printing mechanism and at least one non-contact heater; and selectively converting operation of the printer between:

a first configuration in which the at least one non-contact heater is activated, the contact heater is absent, the media comprises a flexible media, and the print-heat assembly is vertically spaced above the first frame by a first height; and a second configuration in which the non-contact heater is activated, the media comprises a generally rigid media, the contact heater is present and heats the non-printing side of the generally rigid media, and the print-heat assembly is vertically spaced above the first frame by a second height that is substantially greater than a first height.

11. The printer of claim 10, comprising:

operating the printer in the first configuration includes supporting the flexible media on the first frame via a roll-to-roll mechanism; and operating the printer in the second configuration includes supporting the generally rigid via releasably retaining the rigid media on a media carrier that is slidably movable relative to the first frame along the generally horizontal orientation, wherein the media carrier includes the contact heater.

12. A wide format printer comprising:

means for printing ink onto, and heating of, a printing side of a media;

means for supporting the media;

means for selectively heating a non-printing side of the media when the media is a generally rigid media;

means for causing one of a first vertical separation or a second vertical separation between the means for printing ink and the means for supporting, wherein the second vertical separation is substantially greater than the first vertical separation; and means for selecting the first vertical separation when the media is a flexible media and selecting the second vertical separation when the media is the generally rigid media.

13. The wide format printer of claim 12 wherein the means for printing ink onto comprises:

a printing mechanism including a printhead array;

at least one non-contact heating mechanism that is spaced apart from, in a fixed relationship, the printing mechanism along a generally horizontal orientation and along a generally vertical orientation.

14. The wide format printer of claim 12 wherein the means for selecting comprises a controller, wherein when the first vertical separation is present, the controller is configured to activate the means heating the printing side of the media, and wherein when the second vertical separation is present, the controller is configured to activate the means for selectively heating the non-printing side of the media and to activate the means for heating the printing side of the media.

15. The wide format printer of claim 14 wherein the means for supporting includes a media carrier that is slidably movable relative to the means for printing and that is configured to releasably retain the rigid media on the media carrier, wherein the means for selectively heating is disposed on the media carrier, and wherein the media carrier is deployed when the media comprises a rigid media.

* * * * *